US006425547B1

(12) United States Patent
Singh

(10) Patent No.: US 6,425,547 B1
(45) Date of Patent: Jul. 30, 2002

(54) SYSTEM AND METHOD FOR PRODUCING CORELESS FABRIC ROLLS

(75) Inventor: Balbir Singh, Media, PA (US)

(73) Assignee: Ethicon, Somerville, NJ (US)

( * ) Notice: Subject to any disclaimer, the term of this patent is extended or adjusted under 35 U.S.C. 154(b) by 0 days.

(21) Appl. No.: 09/387,742

(22) Filed: Aug. 31, 1999

(51) Int. Cl.[7] ..... B65H 35/08

(52) U.S. Cl. ..... 242/527; 242/530.1; 242/531; 242/533.4; 242/542; 242/542.3

(58) Field of Search ..... 242/527, 530.1, 242/531, 533.4, 533.6, 542, 542.3

(56) References Cited

U.S. PATENT DOCUMENTS

| | | | | | |
|---|---|---|---|---|---|
| 2,769,600 | A | | 11/1956 | Kwitek et al. | 242/56 |
| 2,995,314 | A | | 8/1961 | Nystrand | 242/64 |
| 3,116,890 | A | | 1/1964 | Nystrand | 242/64 |
| 3,844,501 | A | | 10/1974 | Spencer | 242/56 |
| 3,871,595 | A | * | 3/1975 | Smolderen | 242/531 |
| 3,930,620 | A | * | 1/1976 | Taitel | 242/531 |
| 4,009,814 | A | | 3/1977 | Singh | 226/113 |
| 4,265,409 | A | | 5/1981 | Cox et al. | 242/56 |
| 4,487,377 | A | | 12/1984 | Perini | 242/56.8 |
| 4,588,138 | A | | 5/1986 | Spencer | 242/64 |
| 4,723,724 | A | | 2/1988 | Bradley | 242/56 |
| 4,807,825 | A | | 2/1989 | Elsner et al. | 242/56 |
| 4,828,195 | A | | 5/1989 | Hertel et al. | 242/66 |
| 4,856,725 | A | | 8/1989 | Bradley | 242/66 |
| 4,962,897 | A | | 10/1990 | Bradley | 242/67.1 |
| 5,337,968 | A | | 8/1994 | De Bin et al. | 242/521 |
| 5,402,960 | A | | 4/1995 | Oliver et al. | 242/527.1 |
| 5,417,382 | A | | 5/1995 | Petitjean et al. | 242/527 |
| 5,505,402 | A | | 4/1996 | Vigneau | 242/527.1 |
| 5,518,200 | A | | 5/1996 | Kaji et al. | 242/538.1 |
| 5,538,199 | A | | 7/1996 | Biagiotti | 242/541.2 |
| 5,690,297 | A | | 11/1997 | McNeil et al. | 242/533.4 |
| 5,810,282 | A | | 9/1998 | McNeil et al. | 242/533.4 |
| 5,839,680 | A | | 11/1998 | Biagiotti | 242/160.1 |
| 5,845,867 | A | | 12/1998 | Hould et al. | 242/527 |
| 5,909,856 | A | * | 6/1999 | Myer et al. | 242/530 |
| 5,931,406 | A | | 8/1999 | Siebert | 242/541.4 |

FOREIGN PATENT DOCUMENTS

| | | |
|---|---|---|
| WO | 9640578 | 12/1996 |

* cited by examiner

*Primary Examiner*—John Q. Nguyen
(74) *Attorney, Agent, or Firm*—Baker Botts L.L.P.

(57) ABSTRACT

A system for producing coreless fabric rolls includes a feed station (12) operable to supply a leading edge of a fabric web (24) from a parent roll (18). The system includes a first tucking station (132) operable to position the leading edge of the fabric web (24) adjacent one of a plurality of spindles (48, 50, 52) coupled to a turret (46). The system also includes a winding station (38) comprising a winding roller (36). The winding station (38) is operable to receive the leading edge in a nip defined by the spindle (48, 50, 52) and the winding roller (36) and wind the fabric web (24) into a fabric roll about the spindle (48, 50, 52). The system also includes a cutting station (40) operable to separate the fabric roll from a remaining portion of the fabric web (24). The system also includes a second tucking station (42) operable to receive the spindle (48, 50, 52) from the winding station (36) and wind a trailing edge of the fabric roll about the fabric roll.

39 Claims, 6 Drawing Sheets

SYSTEM AND METHOD FOR PRODUCING CORELESS FABRIC ROLLS

TECHNICAL FIELD OF THE INVENTION

The present invention relates generally to the field of fabric or paper converting processes and machinery, and more particularly, to a system and method for producing coreless fabric rolls.

BACKGROUND OF THE INVENTION

Fabric rewind systems are generally used to unwind paper or fabric from a large parent roll and conduct the fabric through a finishing or converting operation. For example, the converting operation may include rewinding the fabric into a roll of a specific size which is generally smaller than the size of the parent roll. For example, the system may be used to produce products such as rolls of sanitary or tissue paper.

An example of a fabric rewind system may include a plurality of mandrels coupled to a rotatable turret. The mandrels rotate in a circular path a fixed distance from an axis of the turret. As the turret rotates, cores are placed on each mandrel, adhesive or glue is applied to the cores, and then the fabric is brought into contact with the cores. The cores are then driven in rotation by rotating the mandrels to wind the fabric about the cores.

An example of a coreless fabric rewind system may include a pair of winding rollers and an actuator to adjust the position of one winding roller relative to the other winding roller. The winding rollers are brought into contact with each other to sever fabric disposed between the winding rollers. As the winding rollers rotate in the same direction, the severed end of fabric curls on itself to begin the formation of a fabric roll. The actuator controls the position of one of the winding rollers to allow for an increase in diameter of the fabric roll during formation.

Prior systems suffer several disadvantages. For example, systems including rotating turrets may require actuators to adjust the position of either winding rollers or the turret prior to, during, and/or after the winding process to avoid interference between the fabric rolls, winding rollers, or other system components during rotation of the turret. Additionally, turret systems do not generally accommodate surface winding of the roll.

Coreless winding systems generally initiate winding by compressing the severed end of the fabric to roll the severed end back on itself to begin the fabric roll. Thus, this process compresses and flattens the fabric, thereby creating a hard center portion of the fabric roll.

SUMMARY OF THE INVENTION

Accordingly, a need has arisen for a system and method for producing coreless fabric rolls that increases the efficiency and reduces the amount of movement of system components. The present invention provides a system and method for producing coreless fabric rolls that address the short comings of prior systems and methods.

According to one embodiment of the present invention, a system for producing coreless fabric rolls include a winding station operable to wind a fabric web into a fabric roll about one of a plurality of spindles coupled to a turret. The system also includes a cutting station operable to separate the fabric roll from the remaining portion of the fabric web to form a leading edge of a fabric web and a trailing edge of a fabric reroll. The system includes a tucking station operable to receive the spindle from the winding station and wind the trailing edge about the fabric roll. The system further includes a stripping station operable to receive the spindle from the tucking station and remove the fabric roll from the spindle.

According to another embodiment of the present invention, a method for producing coreless fabric rolls include winding a fabric web about one of the plurality of the spindles to form a fabric roll at a first station. The spindles are coupled to a turret. The method includes transferring a spindle from the first station to a second station and separating the roll from the fabric roll. Separating the fabric roll from the fabric web forms a leading edge of the fabric web and a trailing edge of the fabric roll. The method also includes winding the trailing edge about the fabric roll at the second station and transferring the spindle from the second station to a third station. The method further includes removing the fabric roll from the spindle at the third station.

The technical advantages of the present invention include providing a system and method for producing wound articles with increased efficiency over prior systems and methods. For example, according to one aspect of the present invention, a rotating turret transfers a plurality of spindles through different stations to produce a fabric roll. Thus, the present invention provides an increased cycle rate for producing fabric rolls.

Another technical advantage of the present invention includes reduced movement of system components, thereby increasing efficiency and decreasing the amount of time required to form fabric rolls. For example, according to one aspect of the present invention, a rotating turret transfers a plurality of spindles through different stations along a generally hypocycloidal path, thereby substantially eliminating interference between the fabric rolls and other system components. Additionally, the present invention substantially eliminates a requirement to translate various system components toward or away from the fabric roll during formation of the fabric roll or to transfer the spindles between different stations.

Other technical advantages of the present invention will be readily apparent to one skilled in the art from the following figures, descriptions and claims.

BRIEF DESCRIPTION OF THE DRAWINGS

For a more complete understanding of the present invention and the advantages thereof, reference is now made to the following description taken in connection with the accompanying drawings, in which.

DETAILED DESCRIPTION OF THE INVENTION

Embodiments of the present invention and the advantages thereof are best understood by referring to the following descriptions and drawings, wherein like numerals are used for like and corresponding parts of the drawings.

Figure 1:
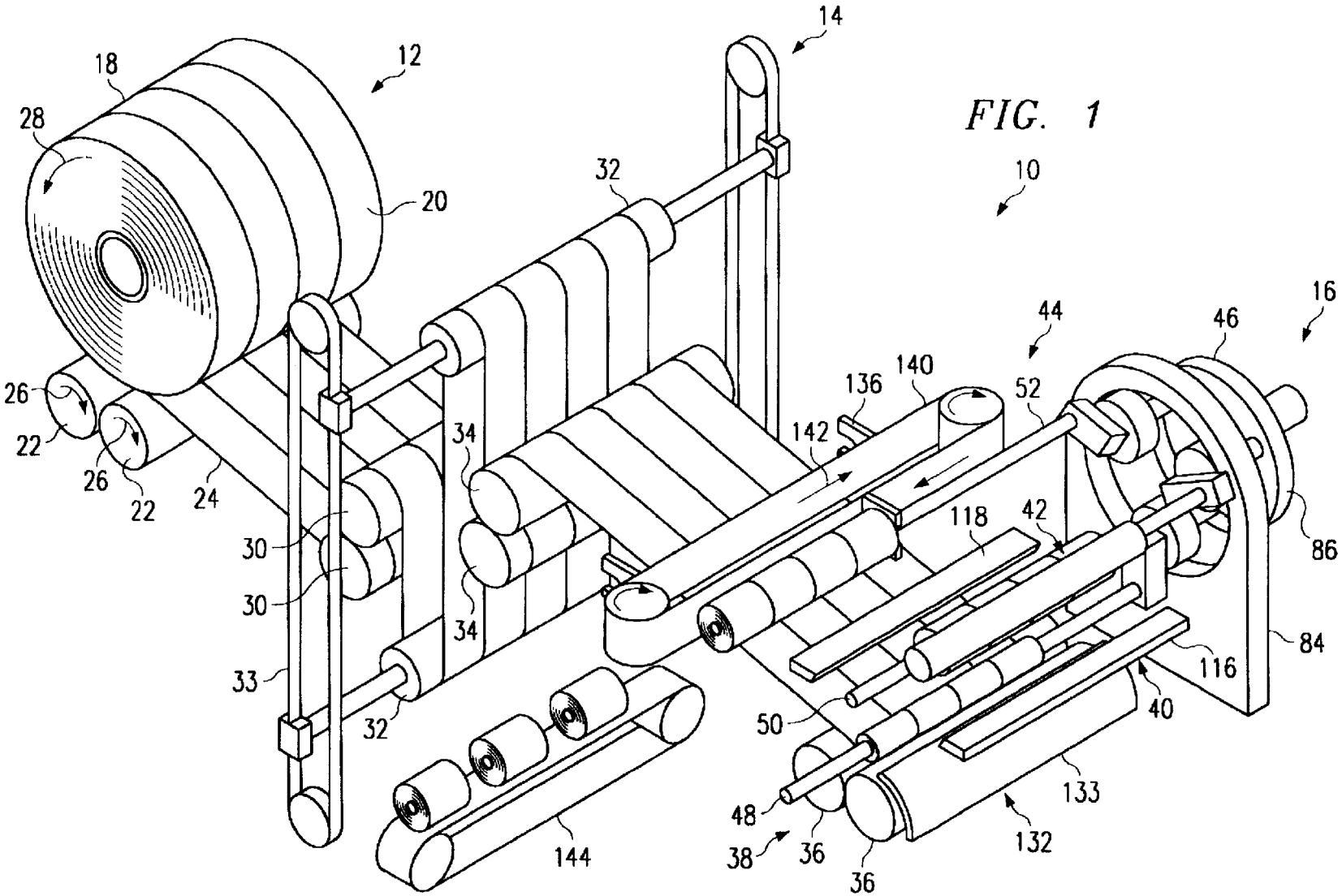
FIG. 1 is a diagram illustrating a system for producing coreless fabric rolls in accordance with an embodiment of the present invention.

FIG. 1 is a diagram illustrating a system 10 for producing coreless fabric rolls in accordance with an embodiment of the present invention. System 10 includes a feed station 12, and accumulator 14 and a rewind station 16. Feed station 12 comprises a parent roll of fabric 18 rotatably mounted to an unwind support (not explicitly shown). Parent roll 18 may comprise paper, woven material, non-woven material or other suitable materials for producing coreless fabric rolls. For example, parent roll 18 may include woven or non-woven cotton or rayon/polyester fabric which may be used for producing rolled bandages. Parent roll 18 may also comprise one or more roll units 20 of fabric.

Feed station 12 also comprises unwind rollers 22 for feeding a fabric web 24 downstream from parent roll 18. Unwind rollers 22 rotate in the direction indicated by arrows 26 to control the feed rate of fabric web 24 downstream from parent roll 18. Thus, in operation, fabric web 24 is unwound from parent roll 18 by rotating parent roll 18 in a direction indicated by arrow 28. As used throughout this description "downstream" relates to the direction of fabric travel though system 10, whereas the term "upstream" refers to a direction opposite that of fabric travel.

Fabric web 24 is fed downstream to feed rollers 30 and accumulator 14. Accumulator 14 comprises festoon rollers 32 that move toward or away from each other to discharge or accumulate, respectively, a reserve portion of fabric 24. Festoon rollers 32 may be driven by a chain or timing belt 33 to control an amount of the reserve portion of fabric web 24 accumulated or discharged; however, other suitable devices or methods may be used to control the movement and speed of festoon rollers 32.

In operation, unwind rollers 22 and feed rollers 30 feed fabric web 24 from parent roll 18 to accumulator 14 at a substantially constant rate of speed, thereby maintaining a substantially constant amount of tension in fabric web 24. Unwind rollers 22 and feed rollers 30 may be electrically and/or mechanically coupled such that unwind rollers 22 and feed rollers 30 operate at substantially the same speed. During winding of fabric rolls at rewind station 16, accumulator 14 accumulates the reserve portion of fabric web 24 to accommodate a reduced feed rate of fabric web 24 to rewind station 16. In response to an increase in the feed rate of fabric web 24 to rewind station 16, accumulator 14 discharges the reserve portion of fabric web 24. Thus, accumulator 14 accumulates the reserve portion of fabric web 24 when the feed rate to rewind station 16 is less than the feed rate of feed station 12 and discharges the reserve portion of fabric web 24 when the feed rate to rewind station 16 is greater than the feed rate of feed station 12.

Fabric web 24 is fed downstream from accumulator 14 through draw rollers 34 to rewind rollers 36 of rewind station 16. Draw rollers 34 and rewind rollers 36 may be electrically and/or mechanically coupled such that draw rollers 34 and rewind rollers 36 operate at substantially the same speed, thereby maintaining a substantially constant tension of fabric web 24. Additionally, feed rollers 30 and draw rollers 34 operate to isolate accumulator 14 to maintain a substantially constant tension of fabric web 24.

Rewind station 16 comprises a winding station 38, a cutting station 40, a tucking station 42, and a stripping station 44. Rewind station 16 also includes a turret 46 comprising spindles 48, 50 and 52. In operation, turret 46 transfers spindles 48, 50, and 52 in a three-cusp hypocycloidal path between stations 38, 42, and 44. Briefly, fabric web 24 is wound about spindles 48, 50, and 52 at winding station 38 using winding rollers 36 as each spindle 48, 50, and 52 is transferred through winding station 38. Cutting station 40 severs the wound fabric rolls from fabric web 24 and tucking station 40 winds any remaining fabric after severing about the wound fabric rolls. The wound fabric rolls are removed from spindles 48, 50, and 52 at stripping station 44.

Figure 2:
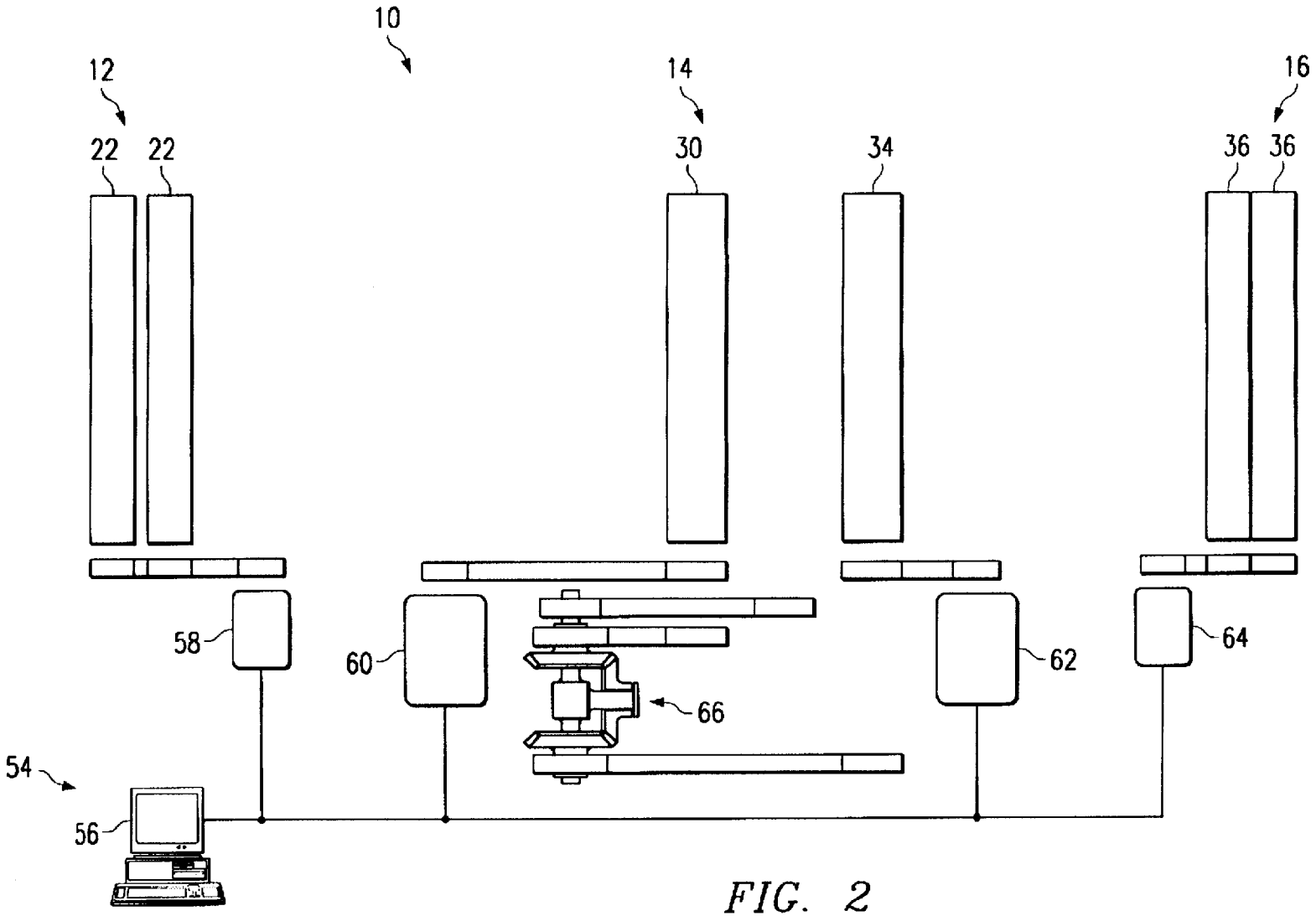
FIG. 2 is a diagram illustrating a control system for the system for producing coreless fabric rolls in accordance with the an embodiment of the present invention.

FIG. 2 is a diagram illustrating a control system 54 of system 10 in accordance with an embodiment of the present invention. Control system 54 comprises a controller 56 and servo motors 58, 60, 62, and 64. Controller 56 comprises a computer, workstation, mini-computer, mainframe or other computing device. Controller 56 controls the operation of motors 58, 60, 62, and 64. For example, motor 58 may be slaved to motor 60, and controller 56 may control the operation of motor 60 such that fabric web 24 is fed at a substantially constant rate of speed from parent roll 18 to accumulator 14.

Additionally, for example, motor 64 may be slaved to motor 62, and controller 56 may control the operation of motor 62 to control the feed rate of fabric web 24 from accumulator 14 to rewind station 16. Thus, motors 62 and 64 may be controlled to deliver a predetermined length of fabric web 24 to rewind station 16 for producing fabric rolls.

As illustrated in FIG. 2, accumulator 14 comprises a differential 66 to control operation of festoon rollers 32 to accumulate or discharge a reserve portion of fabric web 24. For example, differential 66 may be mechanically coupled to feed rollers 30 and draw rollers 34 to control timing belt 33. However, a servo motor or other suitable type of method or device may be used to control timing belt 33.

Figure 3:
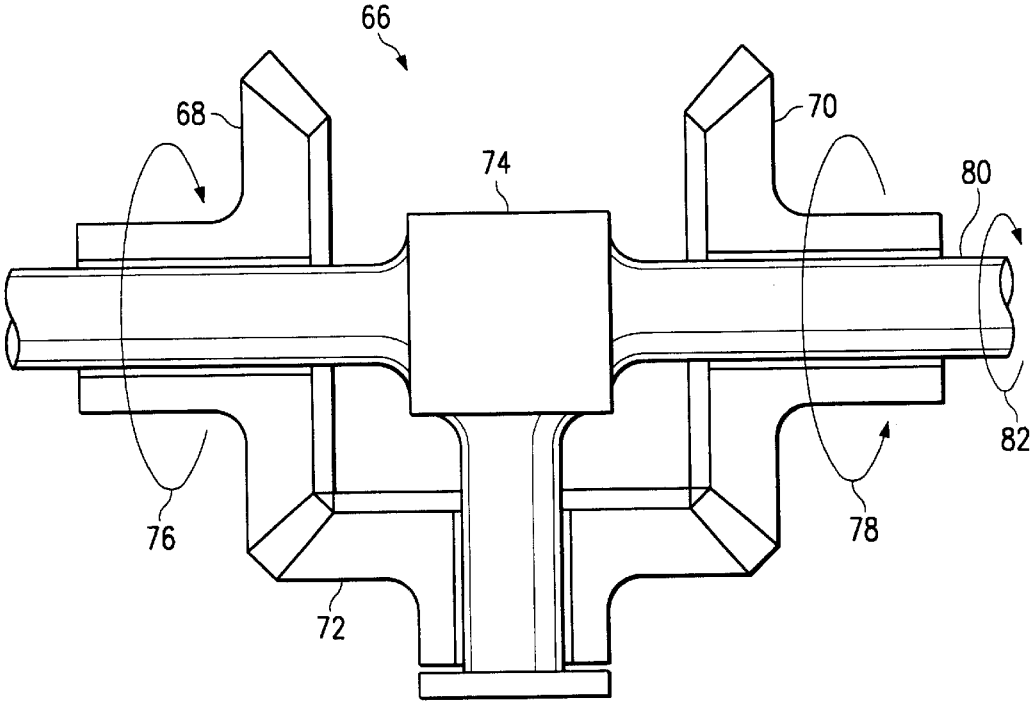
FIG. 3 is a diagram illustrating a differential of an accumulator for the system in accordance with an embodiment of the present invention.

FIG. 3 is a diagram illustrating differential 66 of system 10 in accordance with an embodiment of the present invention. Differential 66 comprises an input gear 68, an input gear 70, a spider pinion gear 72 and a spider 74. Differential 66 receives input from feed rollers 30 through input gear 68 in the direction indicated by arrow 76. Differential 66 also receives input from draw rollers 34 through input gear 70 in the direction indicated by arrow 78. In operation, feed rollers 30 are operated at a substantially constant speed to provide a substantially constant feed rate of fabric web 24 to accumulator 14. Input from draw rollers 34 is cyclic as fabric rolls are produced at rewind station 16. Thus, differential 66 operates to regulate the position of festoon rollers 32 based on input speeds from feed rollers 32 and draw rollers 34.

In operation, if the input from feed rollers 30 is greater than the input from draw rollers 34, an output shaft 80 of spider 74 delivers output to timing belt 33 in the direction indicated by arrow 82. If the input from feed rollers 30 is less than the input from draw rollers 32, the output from shaft 80 of spider 74 is in a direction opposite that indicated by arrow 82. If the input from feed rollers 30 equals the input from draw rollers 32, festoon rollers 32 will remain in a substantially static condition. Thus, accumulator 14 accumulates or discharges a reserve portion of fabric web 24 using differential 66 based on the speeds of feed rollers 30 and draw rollers 34.

FIGS. 4A–4D are diagrams illustrating turret 46 of rewind station 16 in accordance with an embodiment of the present invention. Turret 46 comprises a fixed sun gear 84, a planet carrier 86, and planet gears 88 rotatably coupled to sun gear 84. In operation, planet carrier 86 is rotated about the axis of shaft 90 of planet carrier 86. As planet carrier 86 rotates, teeth (not explicitly shown) of planet gears 88 engage teeth (not explicitly shown) of sun gear 84, thereby causing rotation of planet gears 88. Planet gears 88 are coupled to spindles 48, 50, and 52 such that spindles 48, 50, and 52 travel in a generally three-cusp hypocycloidal motion.

Figure 4C:
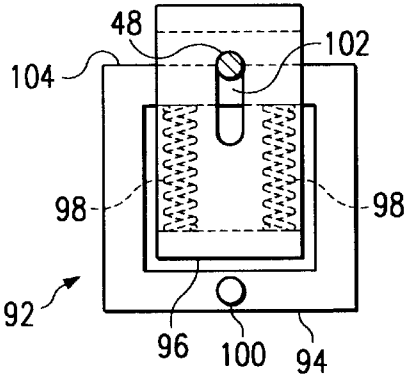
FIGS. 4A–4D are diagrams illustrating a turret of the system in accordance with the embodiment of the present invention.
Figure 4D:
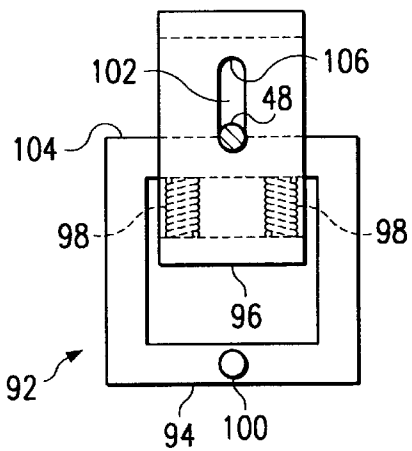
Figure 4B:
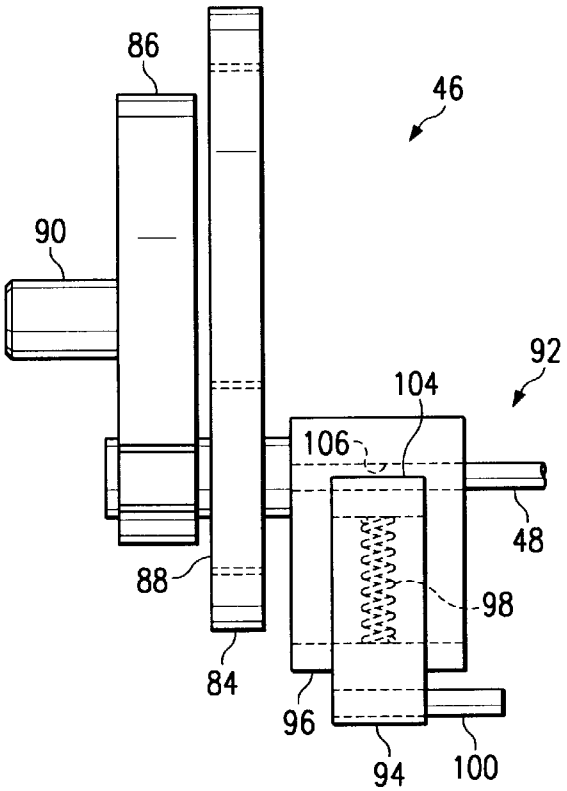
Figure 4A:
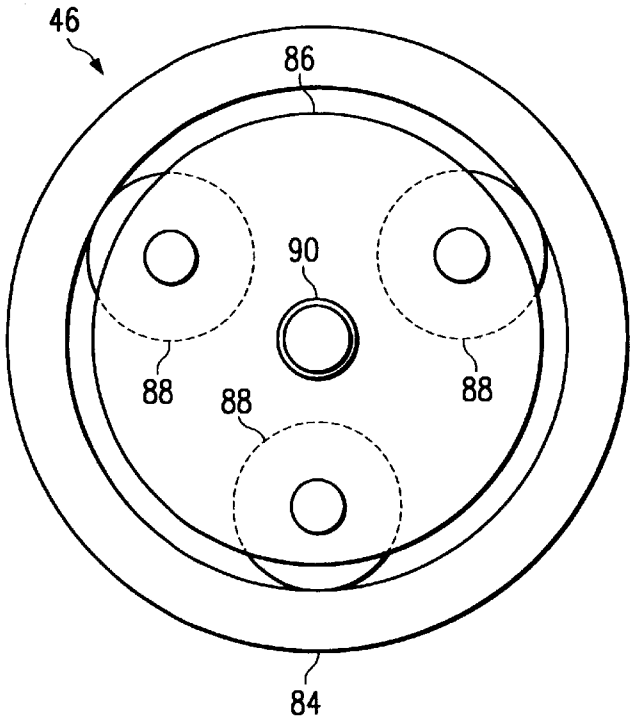

Referring to FIGS. 4B and 4C, spindles 48, 50, and 52 are coupled to planet gears 88 by spindle carriers 92. Spindle carriers 92 each comprise a yoke 94, a support 96, and springs 98 disposed between yoke 94 and support 96. Yoke 94 comprises an outwardly extending pin 100. Support 96 comprises an opening 102 for receiving one of spindles 48, 50, and 52. In operation, yoke 94 cooperates with support 96 such that springs 98 bias a clamping surface 104 of yoke 94 towards a clamping surface 106 of opening 102 of support 96 to secure spindles 48, 50, and 52 within opening 102. Thus, spindle carriers 92 secure spindles 48, 50, and 52 in a predetermined position relative to a center axis of planet gears 88.

Referring to FIG. 4D, as spindles 48, 50, and 52 are positioned at winding station 38, a downwardly directed force is applied to pin 100 to resist the bias force of springs 98 and direct yoke 94 downwardly relative to support 96, thereby releasing spindles 48, 50, and 52 for movement within opening 102. For example, the force may be applied to pin 100 from a pneumatically operated cylinder (not explicitly shown) controlled by controller 56; however, other suitable devices or methods may be used to apply a downwardly directed force to pin 100. As yoke 94 moves downwardly relative to support 96, spindles 48, 50, and 52 also move downwardly within opening 102 so that spindles 48, 50, and 52 are positioned in a nip defined by adjacent winding rollers 36. As fabric web 24 is surface wound about spindles 48, 50, and 52, spindles 48, 50, and 52 are operable to move upwardly within opening 102 to accommodate an increasing diameter of fabric roll formed about spindles 48, 50, and 52. After the fabric roll is formed to a desired size, pin 100 may be released, thereby causing yoke 94 to be biased upwardly from springs 98 to secure spindles 48, 50, and 52. Thus, spindle carriers 92 releasably engage spindles 48, 50, and 52 to locate spindles 48, 50, and 52 in a position for surface winding of spindles 48, 50, and 52, and to accommodate an increasing diameter of the fabric rolls during formation of the fabric rolls.

In the embodiment illustrated in FIGS. 4B–4D, spindle carriers 92 comprise pin 100 for directing yoke 94 downwardly relative to support 96 to releasably engage spindles 48, 50, and 52. However, other suitable methods or devices may be used to releasably engage spindles 48, 50, and 52 to provide positional control of spindles 48, 50, and 52 relative to winding rollers 36.

Figure 5A:
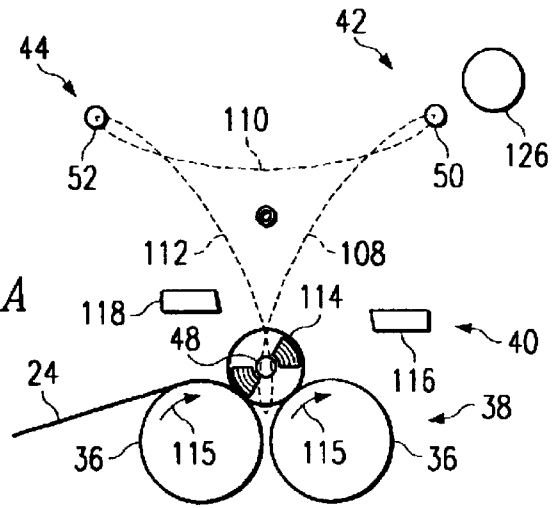
FIGS. 5A–5H are diagrams illustrating the production of coreless fabric rolls in accordance with an embodiment of the present invention.

FIGS. 5A–5H are diagrams illustrating rewind station 16 in accordance with an embodiment of the present invention. Referring to FIG. 5A, rewind station 16 comprises winding station 38, cutting station 40, tucking station 42, and stripping station 44. As described above, turret 46 rotates about a central axis to transfer spindles 48, 50, and 52 between winding station 38, tucking station 42, and stripping station 44 along generally three-cusp hypocycloidal paths 108, 110, and 112.

As illustrated in FIG. 5A, fabric web 24 is wound about spindle 48 using rewind rollers 36 of winding station 38 to form a fabric roll 114. For example, fabric roll 114 may be surface wound about spindle 48 by rotating rewind rollers 36 in the direction indicated by arrows 115. As described above, spindle carrier 92 disengages spindle 48 at winding station 38 to position spindle 48 in a nip defined by adjacent winding rollers 36. Additionally, spindle carrier 92 disengages spindle 48 to allow rotation of spindle 48 caused by the rotation of winding rollers 36. The speed and duration of winding may be controlled using control system 54 to form fabric roll 114 to a desired size. After fabric roll 114 has been wound to the desired size, rotation of winding rollers 36 and draw rollers 34 is dwelled to prevent feeding additional fabric web 24 to winding station 38. Additionally, spindle carrier 92 engages spindle 48 in preparation for indexing of turret 46.

Figure 5B:
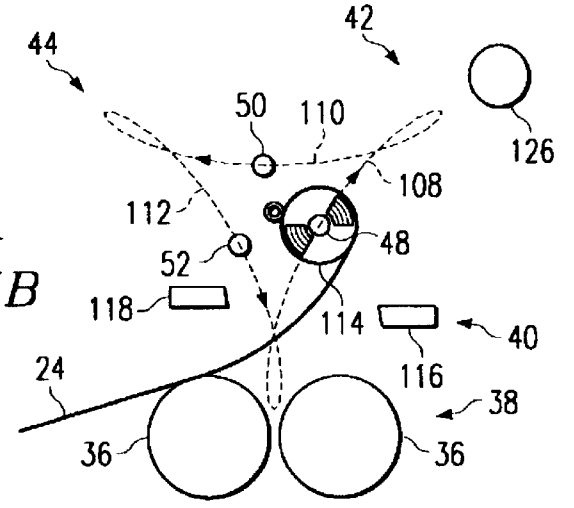

FIG. 5B illustrates an indexing of turret 46 to transfer spindles 48, 50, and 52 between stations 38, 42, and 44. For example, spindle 48 and fabric roll 114 are transferred from winding station 38 to tucking station 42 along hypocycloidal path 108. Additionally, spindle 50 is transferred from tucking station 42 to stripping station 44 along path 110, and spindle 52 is transferred from stripping station 44 to winding station 38 along path 112. Transferring spindles 48, 50, and 52 between stations 38, 42, and 44 along generally hypocycloidal paths 108, 110, and 112 prevents interference between components of rewind station 16 and alleviates additional movement of components of rewind station 16 to avoid interference.

Figure 5C:
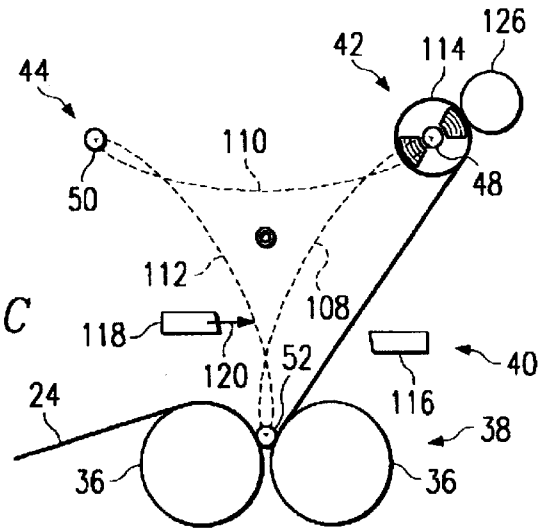

As illustrated in FIG. 5C, turret 46 has completed indexing and has positioned spindle 48 and fabric roll 114 at tucking station 42 and spindle 50 at stripping station 44. Additionally, as described above, spindle carrier 92 disengages spindle 52 at winding station 38, thereby allowing spindle 52 to be disposed within a nip defined by adjacent winding rollers 36. As turret 46 indexes, fabric web 24 is positioned between spindle 52 and rewind rollers 36 such that fabric web 24 becomes secured between rewind rollers 36 and spindle 52 as spindle 52 reaches winding station 38.

Cutting station 40 comprises shear blades 116 and 118 to separate fabric roll 114 from a remaining portion of fabric web 24. As illustrated in FIG. 5C, as spindle 52 reaches winding station 38, spindle 52 causes a tension in a portion of fabric web 24 extending from winding station 38 to fabric roll 114 so that shear blades 116 and 118 may separate fabric web 24 from fabric roll 114. For example, shear blade 118 may be moved in a direction indicated by arrow 120 to cooperate with shear blades 116 to separate fabric web 24 from fabric roll 114. Controller 56 may be used to control actuation of shear blades 116 and 118 to separate fabric web 24 from fabric roll 114.

Figure 5D:
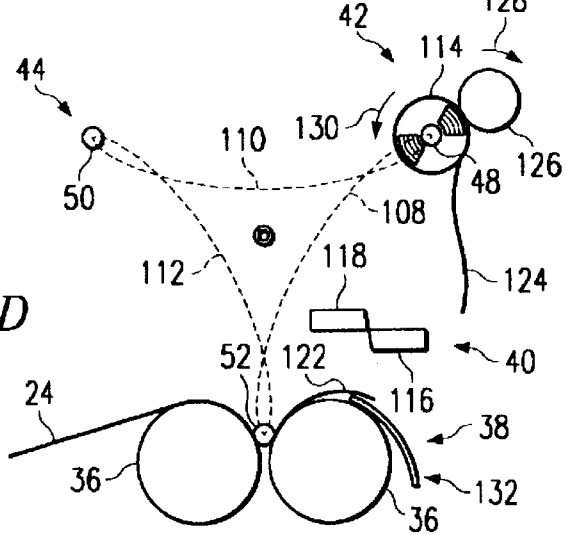

Referring to FIG. 5D, shear blade 118 engages shear blade 116 to separate fabric web 24 from fabric roll 114, thereby forming a leading edge 122 of fabric web 24 and a trailing edge 124 of fabric roll 114. Tucking station 42 comprises a tucking roller 126 to wind trailing edge 124 about spindle 48 and fabric roll 114. For example, tucking roller 126 may be operated in a direction indicated by arrow 128, thereby causing fabric roll 114 to rotate in a direction indicated by arrow 130 to wind trailing edge 124 about fabric roll 114. Controller 56 may be used to operate tucking roller 126 after separation of fabric roll 114 from fabric web 24. Rewind station 16 also comprises a tucking station 132 to position leading edge 122 of fabric web 24 into a position to form another fabric roll about spindle 52.

Figure 5F:
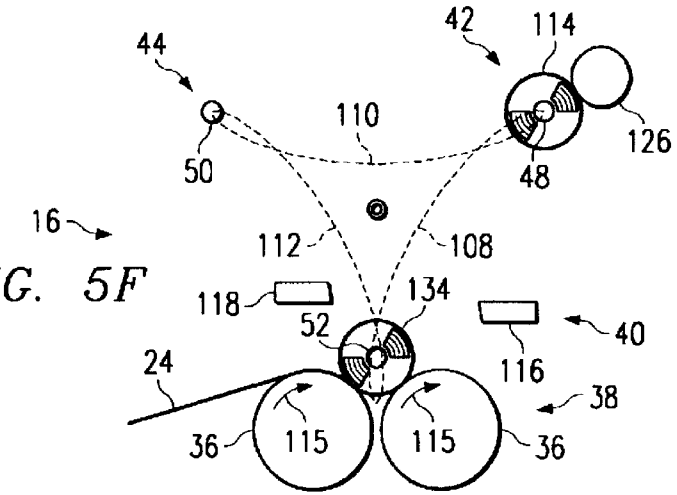
Figure 5E:
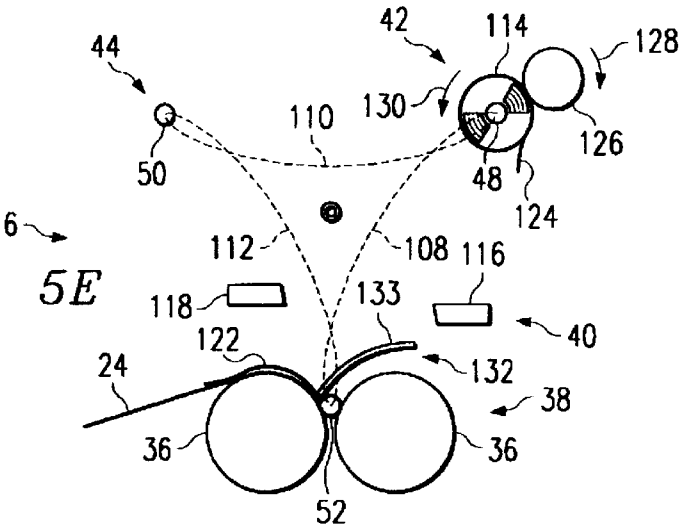

Referring to FIG. 5E, shear blade 118 is retracted and tucking roller 126 continues rotation to wind trailing edge 124 about fabric roll 114. Tucking station 132 comprises an arm 133 to engage leading edge 122 of fabric web 24 and position leading edge 122 about spindle 52 at winding station 38 in preparation for forming another fabric roll. However, tucking station 132 may also comprise other suitable methods or devices for positioning leading edge 122 of fabric web 24 adjacent spindle 52, including, but not limited to, an air jet.

Referring to FIG. 5F, rewind rollers 36 are activated in the direction indicated by arrows 115 to wind fabric web 24 about spindle 52 to form a fabric roll 134. As described above, spindle carrier 92 disengages spindle 52 at winding station 38 to allow movement of spindle 52 to accommodate formation of fabric roll 134. As illustrated in FIG. 5F, spindle 52 moves upwardly away from the nip of winding rollers 36 to accommodate an increase in diameter of fabric roll 134.

Figure 5H:
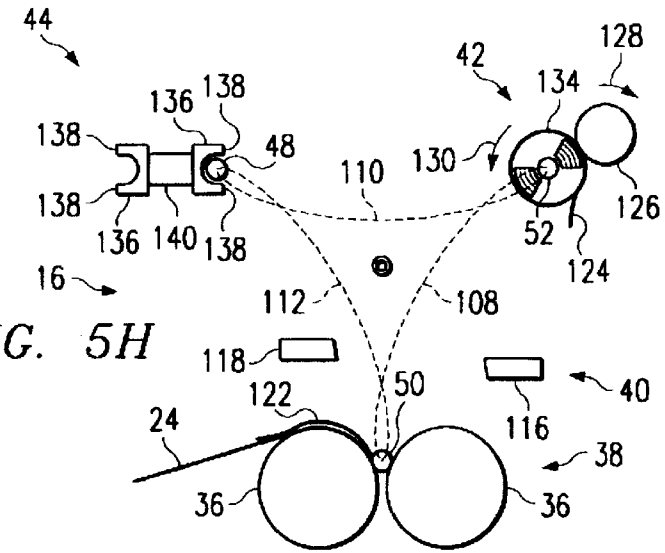
Figure 5G:
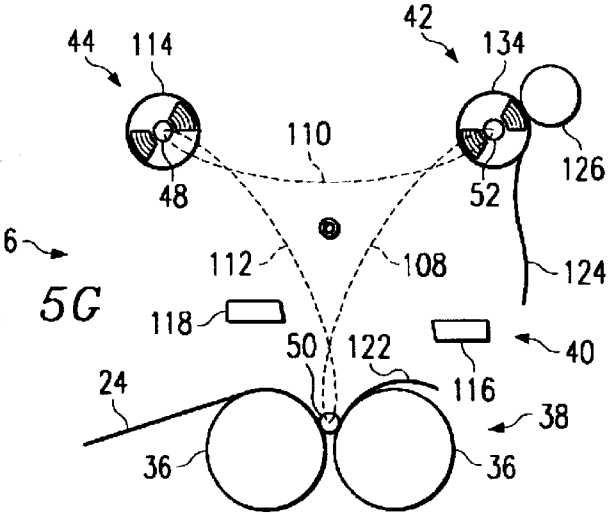

Referring to FIG. 5G, turret 46 indexes and transfers spindle 48 and fabric roll 114 from tucking station 42 to stripping station 44 along hypocycloidal path 110, spindle 52 and fabric roll 134 from winding station 38 to tucking station 42 along hypocycloidal path 108, and spindle 50 from stripping station 44 to winding station 38 along hypocycloidal path 112. As illustrated in FIG. 5G, shear blades 116 and 118 have been releasably engaged to separate fabric web 24 from fabric roll 134, thereby forming leading edge 122 of fabric web 24 and trailing edge 124 of fabric roll 134. Trailing edge 124 may then be wound about spindle 52 and fabric roll 134 using tucking roller 126.

Referring to FIG. 5H, stripping station 44 comprises one or more paddles 136 to remove fabric rolls formed on spindles 48, 50, and 52. Paddles 136 each comprise fingers 138 that extend across and straddle spindles 48, 50, and 52 adjacent fabric rolls formed on spindles 48, 50, and 52. In operation, paddles 136 are translated along spindles 48, 50, and 52 to slide and remove the fabric rolls from spindles 48, 50, and 52.

Paddles 136 may be coupled to a belt 140 for repeated positioning and translating of paddles 136 in stripping station 44. For example, referring to FIG. 1, belt 140 may be driven in a direction indicated by arrow 142 to remove fabric rolls from spindles 48, 50, and 52. Belt 140 may be driven at a speed and with various quantities of paddles 136 to correspond with indexing of turret 46. However, other suitable methods or devices may be used for repeated stripping of fabric rolls from spindles 48, 50, and 52. Fabric rolls may then be transferred to a conveyor 144 or other suitable transfer device or method to transport the fabric rolls to additional processing stations.

Although the present invention and its advantages have been described in detail, it should be understood that various changes, substitutions, and alterations can be made therein without departing from the spirit and scope of the present invention as defined by the appended claims.

What is claimed:

1. A method for producing coreless fabric rolls comprising:

winding a fabric web onto one of a plurality of spindles to form a coreless fabric roll at a first station, the spindles coupled to a turret;

transferring the spindle, after winding the fabric web onto the spindle, from the first station to a second station along a generally hypocycloidal path;

separating the coreless fabric roll from the fabric web;

forming a leading edge of the fabric web and a trailing edge of the coreless fabric roll;

winding the trailing edge about the coreless fabric roll at the second station;

transferring the spindle from the second station to a third station along a generally hypocycloidal path; and removing the coreless fabric roll from the spindle at the third station.

2. The method of claim 1, further comprising:

securing the spindle in a first position relative to the turret; and releasing the spindle at the first station to provide movement of the spindle from the first position to a second position during forming of the coreless fabric roll.

3. The method of claim 1, wherein the removing step comprises disposing a paddle adjacent an end of the coreless fabric roll and translating the paddle along the spindle.

4. The method of claim, 1, further comprising tucking the leading edge of the fabric web adjacent another spindle disposed at the first station.

5. The method of claim 1, wherein the separating step comprises activating a shear blade disposed between the first and second stations to sever the fabric web from the coreless fabric roll.

6. The method of claim 1, further comprising:

providing the fabric web from a feed station at a substantially constant feed rate; and accumulating a reserve portion of the fabric web while the spindle is transferred from the first station to the second station.

7. A system for producing coreless fabric rolls comprising:

a hypocycloidal turret having a plurality of spindles;

a winding station operable to wind a fabric web onto one of the spindles to form a coreless fabric roll;

a cutting station operable to separate the coreless fabric roll from the fabric web to form a leading edge of the fabric web and a trailing edge of the coreless fabric roll;

a tucking station operable to wind the trailing edge about the coreless fabric roll;

a stripping station operable to remove the coreless fabric roll from the spindle; and a control system operable to transfer each of the spindles to the winding, tucking, and stripping stations along a generally hypocycloidal path.

8. The system of claim 7, wherein the turret further Comprises a spindle carrier coupled to each of the spindles to secure each of the spindles in a first position, and wherein the control system is further operable to disengage the spindle carrier from the spindle to provide for movement of the spindle from the first position to a second position in response to forming the coreless fabric roll.

9. The system of claim 7, further comprising:

a feed station operable to provide the fabric web at a substantially constant feed rate; and an accumulator operable to accumulate a reserve portion of the fabric web as the spindles are transferred between each of the winding, tucking, and stripping stations.

10. The system of claim 9, wherein the accumulator is further operable to discharge the reserve portion of the web during forming of the coreless fabric roll.

11. The system of claim 7, wherein the stripping station comprises a paddle having a plurality of fingers, the fingers operable to extend over the spindle, and wherein the control system is further operable to translate the paddle along the spindle to remove the coreless fabric roll from the spindle.

12. The system of claim 7, wherein the cutting station comprises a shear blade, and wherein the control system is further operable to activate the shear blade to separate the coreless fabric roll from the fabric web while the spindle is disposed at the tucking station.

13. A method for producing fabric rolls, comprising:

providing a fabric web at a substantially constant feed rate;

moving a first spindle of a turret to a first station;

accumulating a reserve portion of the fabric web during movement of the first spindle to the first station;

discharging the reserve portion to the first station to form a fabric roll about the first spindle;

transferring the first spindle from the first station to a second station along a generally hypocycloidal path;

accumulating a next reserve portion of the fabric web during transfer of the first spindle from the first station to the second station;

moving a second spindle of the turret to the first station;

separating the fabric roll from the fabric web;

winding a remaining portion of the fabric web about the fabric roll at the second station;

discharging the next reserve portion to the first station to form another fabric roll about the second spindle;

transferring the first spindle from the second station to a third station along a generally hypocycloidal path; and removing the fabric roll from the first spindle at the third station.

14. The method of claim 13, wherein accumulating the reserve portion comprises:

receiving the fabric web from a feed station at a plurality of festoon rollers; and moving the festoon rollers away from each other to accumulate the reserve portion.

15. The method of claim 14, wherein discharging the fabric web comprises moving the festoon rollers toward each other to discharge the reserve portion.

16. The method of claims 13, wherein moving the first spindle comprises moving the first spindle to the first station following a substantially hypocycloidal path.

17. The method of claim 13, further comprising:

receiving the reserve portion of the fabric web at a plurality of rollers of the first station;

disposing a portion of the fabric web adjacent the first spindle; and rotating the plurality of rollers to form the fabric roll about the first spindle.

18. A method for producing fabric rolls, comprising:

disposing a spindle of a turret adjacent a plurality of winding rollers in a winding station;

providing a fabric web from a feed station to an accumulator at a first feed rate;

providing the fabric web from the accumulator to the winding station at a second feed rate;

rotating the plurality of winding rollers to wind the fabric web about the spindle at the winding station to form a fabric roll;

transferring the spindle from the winding station to a tucking station following a substantially hypocycloidal path;

reducing the second feed rate to less than the first feed rate during transfer of the spindle from the winding station to the tucking station; and accumulating a reserve portion of the fabric web at the accumulator when the second feed rate is less than the first feed rate.

19. The method of claim 18, further comprising discharging the reserve portion when the second feed rate is greater then the first feed rate.

20. The method of claim 18, wherein accumulating comprises:

receiving the fabric web at a plurality of festoon rollers of the accumulator; and moving the festoon rollers away from each other to accumulate the reserve portion.

21. The method of claim 20, further comprising discharging the reserve portion from the accumulator by moving the festoon rollers towards each other when the second feed rate is greater than the first feed rate.

22. The method of claim 18, wherein winding comprises:

releasing the spindle to a first position adjacent a plurality of rollers in the winding station;

rotating the rollers to wind the fabric web about the spindle, the spindle moving from the first position to a second position in response to an increasing thickness of the fabric roll; and securing the spindle at the second location for transfer from the winding station.

23. A system for producing a fabric roll, comprising:

a feed station operable to provide a fabric web at a substantially constant feed rate;

a turret operable to intermittently move each of a plurality of spindles into a winding station, a tucking station, and a stripping station through a substantially hypocycloidal path;

the winding station operable to wind the fabric web about one of the spindles; and an accumulator operable to accumulate a reserve portion of the web during movement of the spindles relative to the winding station, the accumulator is further operable to discharge the reserve portion of the fabric web to the winding station after another of the spindles is positioned at the winding station.

24. The system of claim 23, wherein the accumulator comprises a plurality of festoon rollers, the festoon rollers operable to receive the fabric web from the feed station and move away from each other to accumulate the reserve portion.

25. The system of claim 24, wherein the festoon rollers are further operable to move towards each other to discharge the reserve portion to the winding station.

26. The system of claim 23, wherein the winding station comprises a plurality of rollers operable to wind the fabric web about one of the spindles, and wherein the turret comprises a spindle carrier operable to disengage one of the spindles to dispose one of the spindles into a first position adjacent the rollers, the spindle carrier operable to reengage the one spindle in a second position after forming the fabric roll, the one spindle moving from the first position to the second position in response to an increasing diameter of the fabric roll.

27. A system for producing a fabric roll, comprising:

a turret having a plurality of spindles, the turret operable to intermittently move each of the plurality of spindles into a winding station, a tucking station, and a stripping station through a substantially hypocycloidal path;

a feed station operable to provide a fabric web at a first feed rate;

the winding station operable to receive the fabric web at a second feed rate and wind the fabric web about the spindles; and an accumulator operable to receive the fabric web from the feed station and transfer the fabric web to the winding station, the accumulator further operable to accumulate a reserve portion of the fabric web when the second feed rate is less than the first feed rate.

28. The system of claim 27, wherein the accumulator is further operable to discharge the reserve portion to the winding station when the second feed rate is greater than the first feed rate.

29. The system of claim 27, wherein the accumulator comprises a plurality of festoon rollers operable to move away from each other to accumulate the reserve portion.

30. The system of claim 29, wherein the festoon rollers are further operable to move toward each other to discharge the reserve portion to the winding station.

31. The system of claim 27, wherein the turret further comprises a spindle carrier coupled to each of the spindles, each spindle carrier operable to provide for movement of the spindle during formation of the fabric roll in response to an increasing size of the fabric roll.

32. The system of claim 27, wherein the winding station comprises a plurality of rollers operable to rotate relative to one of the spindles to wind the fabric web about the one spindle.

33. The system of claim 32, further comprising an arm operable to position a portion of the fabric web in a nip defined by one of the spindles and one of the plurality of rollers in preparation for rotation of the rollers.

34. A method for producing coreless fabric rolls comprising:

providing a fabric web to a winding station having a winding roller;

rotating a turret having a plurality of spindles to dispose one of the spindles at the winding station;

positioning a portion of the fabric web proximate a nip defined by the spindle and the winding roller;

rotating the winding roller to wind the fabric web onto the spindle at the winding station to form a coreless fabric roll;

separating the coreless fabric roll from the fabric web; and removing the coreless fabric roll from the spindle.

35. The method of claim 34, wherein providing the fabric web comprises providing the fabric web at a substantially constant feed rate, and further comprising accumulating a reserve portion of the fabric web during rotation of the turret.

36. The method of claim 35, further comprising discharging the reserve portion to the winding station after positioning one of the plurality of spindles at the winding station.

37. The method of claim 34, wherein removing the fabric roll comprises disposing a paddle adjacent the fabric roll and translating the paddle along the one spindle.

38. The method of claim 34, further comprising:

disengaging the one spindle to position the one spindle in a first position adjacent the roller; and reengaging the one spindle at a second location after formation of the fabric roll, the one spindle moving from the first location to the second location in response to an increasing size of the fabric roll.

39. The method of claim 34, wherein rotating the roller comprises rotating the roller to form a plurality of coreless fabric rolls on the one spindle, and wherein removing comprises removing each of the plurality of fabric rolls from the one spindle.

* * * * *